US010926575B2

(12) United States Patent
Gupta et al.

(10) Patent No.: US 10,926,575 B2
(45) Date of Patent: Feb. 23, 2021

(54) THREE-WAY MARKER FOR SEWING

(71) Applicant: DPG USA Inc, Schaumburg, IL (US)

(72) Inventors: Nikhil Gupta, Schaumburg, IL (US); Daniel Schaumann, Chicago, IL (US)

(73) Assignee: DPG USA INC., Schaumburg, IL (US)

( * ) Notice: Subject to any disclaimer, the term of this patent is extended or adjusted under 35 U.S.C. 154(b) by 10 days.

(21) Appl. No.: 16/299,039

(22) Filed: Mar. 11, 2019

(65) Prior Publication Data

US 2019/0283487 A1 Sep. 19, 2019

Related U.S. Application Data

(60) Provisional application No. 62/642,225, filed on Mar. 13, 2018.

(51) Int. Cl.

| | |
|---|---|
| ***B43K 29/06*** | (2006.01) |
| ***B43K 23/08*** | (2006.01) |
| ***B43K 23/016*** | (2006.01) |
| ***B43K 21/22*** | (2006.01) |
| ***B43K 29/00*** | (2006.01) |
| ***B43K 23/06*** | (2006.01) |
| ***B43L 23/06*** | (2006.01) |
| *B43L 23/08* | (2006.01) |

(52) U.S. Cl.

CPC ..... *B43K 29/06* (2013.01); *B43K 21/22* (2013.01); *B43K 23/016* (2013.01); *B43K 23/08* (2013.01); *B43K 29/004* (2013.01); *B43L 23/06* (2013.01); *B43L 23/08* (2013.01)

(58) Field of Classification Search

CPC ..... B43K 29/00; B43K 29/06; B43K 23/08; B43K 29/004; B43K 23/016; B43K 21/22; B43K 19/00; B43K 19/003; B43K 19/02; B43K 21/006; B43L 23/00; B43L 23/06; B43L 23/004; B43L 23/08

USPC ..... 401/88, 195, 52, 18, 16, 19, 34, 36, 37, 401/38

See application file for complete search history.

(56) References Cited

U.S. PATENT DOCUMENTS 3,242,526 A * 3/1966 Wilton ..... F21V 35/00 408/211
5,638,566 A * 6/1997 Wu ..... B25F 1/02 401/18
5,957,602 A * 9/1999 Rosenthal ..... A45D 40/04 401/51

(Continued)

*Primary Examiner* — David J Walczak
(74) *Attorney, Agent, or Firm* — Robert S. Alexander; Ferrells, PLLC; Anna Kinney

(57) ABSTRACT

A marker ensemble includes a multi-purpose marking tool and a sharpener. The marking tool has a shell, retention sleeve, compression spring, control tab, reversible disk holder, and cap. The shell has an exit opening, an access opening with a mounting socket, and a medially located lateral control slot through which the control tab extends. The retention sleeve has a collet, compressed by the compression spring and uncompressed by the control tab. The disk holder has a body with a retention ridge and a pair of lugs extending from each end to retain a marking disk. One marking disk has a circular periphery and the other marking disk has a toothed periphery. The cap is mounted upon either end. The sharpener includes a blade with a sharpened edge secured to a body with an upper surface, a peripheral surface with a shoulder, waist, and hip, and a lower surface.

10 Claims, 22 Drawing Sheets

(56) References Cited

U.S. PATENT DOCUMENTS 6,921,223 B2 * 7/2005 Marschand ..... B43K 23/008
401/17

* cited by examiner 100
102
104
106
108
109
110
112
114
116
118
120
129

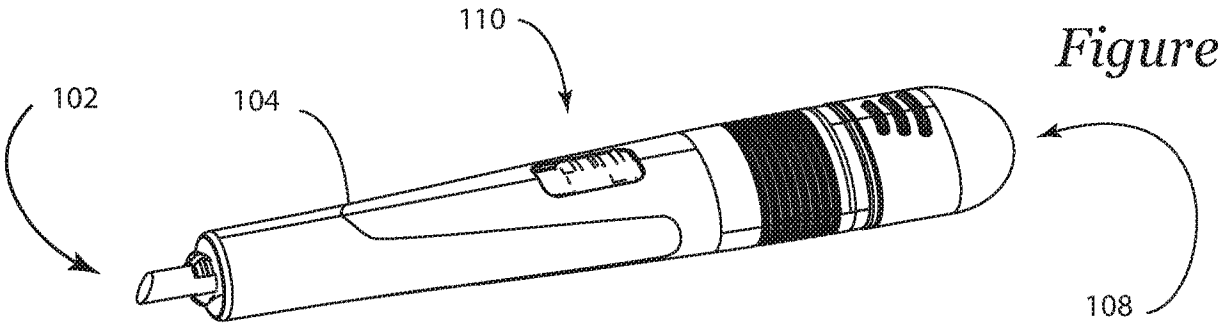
Figure 6
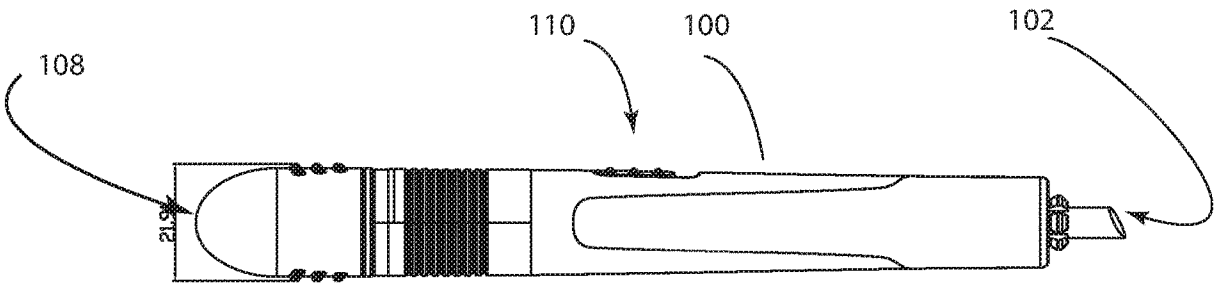
Figure 7
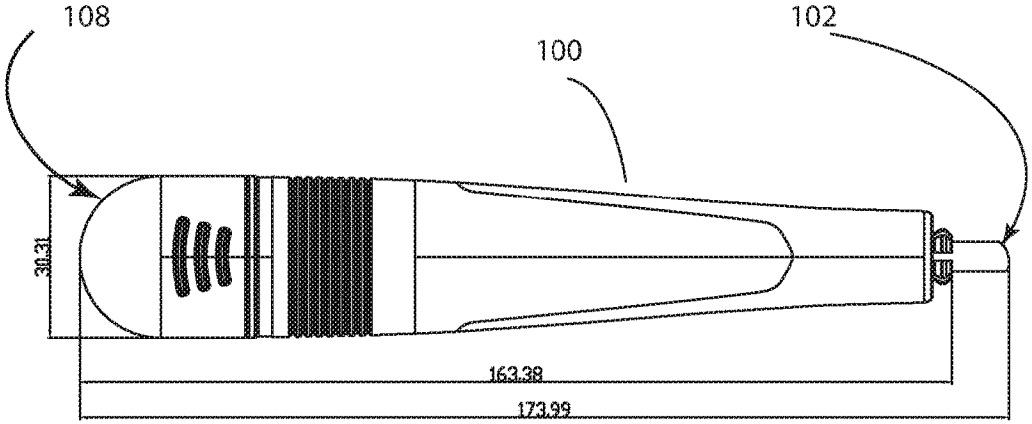
Figure 8
Figure 9
Figure 10

102
100

102
100

102
100

102
100

102
100

102
100

A
A

100

102
100

102
100
SECTION A-A
SCALE 1:1

116
115

129
114

114
129

115

114
99.01
102
116

115

14.22
22.95

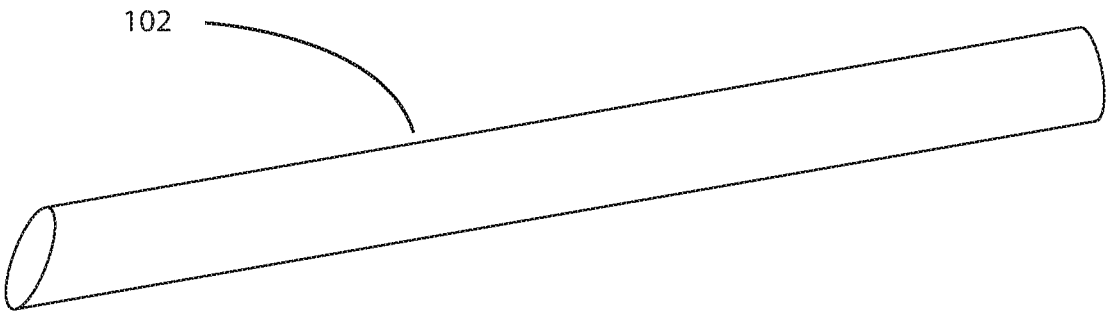
Figure 39
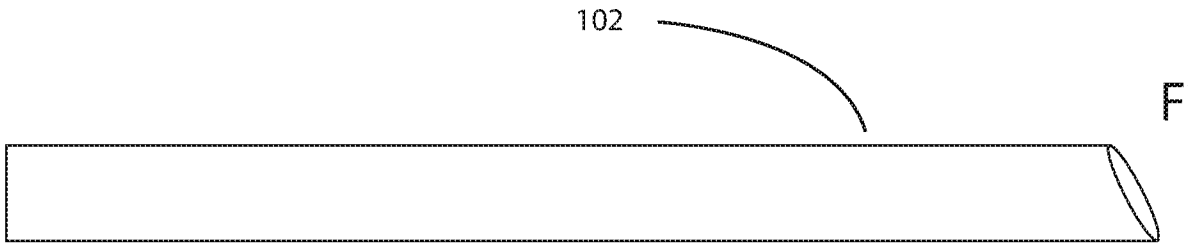
Figure 40
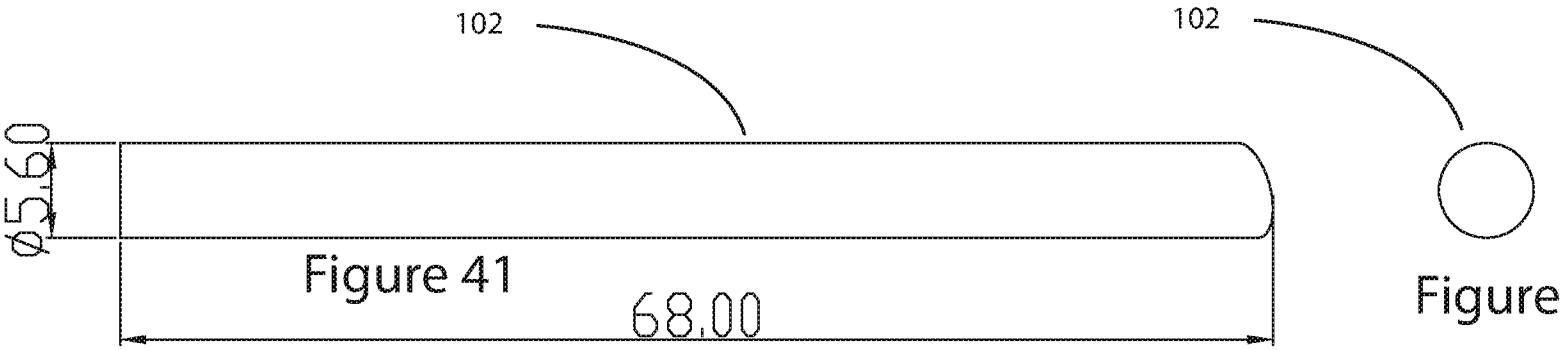
Figure 41
Figure 42

THREE-WAY MARKER FOR SEWING

CLAIM FOR PRIORITY

This Non-Provisional patent application is based on U.S. Provisional Patent Application Ser. No. 62/642,225, filed on Mar. 13, 2018, the priority of which is claimed, and the disclosure of which is incorporated by reference.

BACKGROUND OF THE INVENTION

Seamstresses often work from a pattern printed upon a thin sheet of semi translucent paper, almost glassined, comprising markings indicating desired locations of cut lines and seams for the desired garment. In some cases, the pattern can be used by merely pinning it to the material and destructively following the markings when forming the pieces of material to be combined in the sewing operations. More commonly, seamstresses prefer to transfer the markings to the material either by use of chalk or by use of tracing wheels, also referred to as marking discs, to form either chalk lines or indentations in the fabric. Tracing wheels usually come in one of two varieties, smooth wheels having a circular blade-like outer periphery and toothed wheels somewhat resembling the blades of circular saws. In many cases, the seamstress will find it expedient to use both kinds of tracing wheels as well as chalk to layout the pattern on the fabric to be cut and combined by sewing. This invention relates to a three-way marker for use in sewing combining both types of tracing wheels with a chalk holder so that the seamstress never has to go searching for the appropriate marker during the fabric layout procedure. Desirably, the chalk in the marker of the present invention will have a diameter in excess of about 4 mm in contrast to the size of about 2.6 mm conventionally used. Preferably the chalk will have a diameter in excess of about 4 to 5 mm and most preferably will have a diameter of 5.6 mm.

SUMMARY OF THE INVENTION

A multi-purpose marking tool for use in sewing comprising: a generally infundibulate shell having an oval cross-section having a longitudinally extending cavity therethrough, said longitudinally extending opening terminating at one end of said shell in an exit opening and an access opening at the other with a medially located lateral control slot in said shell, the walls of said generally infundibulate shell defining a mounting socket encompassing said access opening; an elongated retention sleeve having a collet at one end, said collet being adapted to pass through the exit opening of said generally infundibulate shell, said elongated retention sleeve being adapted to be disposed within said generally infundibulate shell; said elongated retention sleeve being adapted to longitudinally reciprocate within said generally infundibulate shell between an extended posture wherein said collet is uncompressed and a retracted posture in which said collet is compressed; a coiled compression spring encompassing said elongated retention sleeve, engaging the inner surface of said generally infundibulate shell and urging said elongated retention sleeve into said posture in which said collet is compressed; a control tab extending through said medially located lateral control slot in said shell and engaging said elongated retention sleeve enabling said elongated retention sleeve to be urged against said compression spring into said extended posture wherein said collet is uncompressed; a reversible disk holder comprising a flattened body having a medial retention ridge defined thereabout, said medial retention ridge adapted to reversibly mount in, and be retained within, said socket in said generally infundibulate shell, said body having a pair of lugs extending longitudinally from each end thereof, each pair of lugs being adapted to rotably retain a marking disk therebetween, the outer periphery of each said marking disk extending beyond said lugs, one said pair of lugs retaining a marking disk with a circular periphery, the other pair a marking disk with a toothed periphery; and a cap adapted to removably mount, and be retained, upon either end of said reversible disk holder, encompassing one said marking disk when so mounted.

In one aspect of the invention, a sharpener is provided, comprising a body having a passage therethrough with a blade secured to said body said blade having a sharpened edge, said sharpened edge protruding into said passage, said body of said sharpener having a pilsner shaped exterior peripheral surface having an overall height of about 25-40 mm with a relatively flat upper surface having a diameter of about 50 to 60% of said height of said sharpener with said peripheral surface flaring gently outwardly therefrom to a shoulder having a diameter which is both about 60 to 70% of said height of said sharpener and about 10% greater than the diameter of said upper surface, said shoulder being at about 90-99% of the height of said sharpener, said peripheral surface narrowing to a waist located at a height of about 15-30% of the overall height of said sharpener, said waist having a diameter of about 40-50% of the height of said sharpener, said peripheral surface flaring outwardly to a hip having a diameter at least about 5-15% greater than the diameter of said waist, said hip being located between said waist and a lower surface.

In another aspect of the invention, a marker ensemble is provided, comprising a multi-purpose marking tool for use in sewing and a sharpener. The multi-purpose marking tool comprises a generally infundibulate shell having an oval cross-section having a longitudinally extending cavity therethrough, said longitudinally extending cavity terminating at one end of said shell in an exit opening and an access opening at the other with a medially located lateral control slot in said shell, the walls of said generally infundibulate shell defining a mounting socket encompassing said access opening; an elongated retention sleeve having a collet at one end, said collet being adapted to pass through the exit opening of said generally infundibulate shell, said elongated retention sleeve being adapted to be disposed within said generally infundibulate shell; said elongated retention sleeve being adapted to longitudinally reciprocate within said generally infundibulate shell between an extended posture wherein said collet is uncompressed and a retracted posture in which said collet is compressed; a coiled compression spring encompassing said elongated retention sleeve, engaging the inner surface of said generally infundibulate shell and urging said elongated retention sleeve into said posture in which said collet is compressed; a control tab extending through said medially located lateral control slot in said shell and engaging said elongated retention sleeve, enabling said elongated retention sleeve to be urged against said compression spring into said extended posture wherein said collet is uncompressed; a reversible disk holder comprising a flattened cylindrical body having a medial retention ridge defined thereabout, said medial retention ridge adapted to reversibly mount in, and be retained within, said socket in said generally infundibulate shell, said body having a pair of lugs extending longitudinally from each end thereof, each pair of lugs being adapted to rotably retain a marking disk therebetween, the outer periphery of each said marking disk extending beyond said lugs, one said pair of lugs retaining a marking disk with a circular periphery, the other pair retaining a marking disk with a toothed periphery; and a cap adapted to removably mount, and be retained, upon either end of said reversible disk holder, encompassing one said marking disk when so mounted. The sharpener comprises a body having a passage therethrough with a blade secured to said body said blade having a sharpened edge, said sharpened edge protruding into said passage, said body of said sharpener having a pilsner shaped exterior peripheral surface having an overall height of about 25-40 mm with a relatively flat upper surface having a diameter of about 50 to 60% of said height of said sharpener with said peripheral surface flaring gently outwardly therefrom to a shoulder having a diameter which is both about 60 to 70% of said height of said sharpener and about 10% greater than the diameter of said upper surface, said shoulder being at about 90-99% of the height of said sharpener, said peripheral surface narrowing to a waist located at a height of about 15-30% of the overall height of said sharpener, said waist having a diameter of about 40-50% of the height of said sharpener, said peripheral surface flaring outwardly to a hip having a diameter at least about 5-15% greater than the diameter of said waist, said hip being located between said waist and a lower surface. A number of horizontal slots are cut into said peripheral surface to enhance grippability.

In another aspect of the invention, a marker ensemble is provided, comprising a multi-purpose marking tool for use in sewing, a sharpener, and a chalk holder. The multi-purpose marking tool comprises a generally infundibulate shell having an oval cross-section having a longitudinally extending cavity therethrough, said longitudinally extending cavity terminating at one end of said shell in an exit opening and an access opening at the other with a medially located lateral control slot in said shell, the walls of said generally infundibulate shell defining a mounting socket encompassing said access opening; an elongated retention sleeve having a collet at one end, said collet being adapted to pass through the exit opening of said generally infundibulate shell, said elongated retention sleeve being adapted to be disposed within said generally infundibulate shell; said elongated retention sleeve being adapted to longitudinally reciprocate within said generally infundibulate shell between an extended posture wherein said collet is uncompressed and a retracted posture in which said collet is compressed; a coiled compression spring encompassing said elongated retention sleeve, engaging the inner surface of said generally infundibulate shell and urging said elongated retention sleeve into said posture in which said collet is compressed; a control tab extending through said medially located lateral control slot in said shell and engaging said elongated retention sleeve, enabling said elongated retention sleeve to be urged against said compression spring into said extended posture wherein said collet is uncompressed; a reversible disk holder comprising a flattened cylindrical body having a medial retention ridge defined thereabout, said medial retention ridge adapted to reversibly mount in, and be retained within, said socket in said generally infundibulate shell, said body having a pair of lugs extending longitudinally from each end thereof, each pair of lugs being adapted to rotably retain a marking disk therebetween, the outer periphery of each said marking disk extending beyond said lugs, one said pair of lugs retaining a marking disk with a circular periphery, the other pair retaining a marking disk with a toothed periphery; and a cap adapted to removably mount, and be retained, upon either end of said reversible disk holder, encompassing one said marking disk when so mounted. The sharpener comprises a body having a passage therethrough with a blade secured to said body said blade having a sharpened edge, said sharpened edge protruding into said passage, said body of said sharpener having a pilsner shaped exterior peripheral surface having an overall height of about 25-40 mm with a relatively flat upper surface having a diameter of about 50 to 60% of said height of said sharpener with said peripheral surface flaring gently outwardly therefrom to a shoulder having a diameter which is both about 60 to 70% of said height of said sharpener and about 10% greater than the diameter of said upper surface, said shoulder being at about 90-99% of the height of said sharpener, said peripheral surface narrowing to a waist located at a height of about 15-30% of the overall height of said sharpener, said waist having a diameter of about 40-50% of the height of said sharpener, said peripheral surface flaring outwardly to a hip having a diameter at least about 5-15% greater than the diameter of said waist, said hip being located between said waist and a lower surface. A number of horizontal slots are cut into said peripheral surface to enhance grippability. Two opposing sides of the chalk holder lid have rounded rectangular grip protrusions.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures:

FIGS. 6, 7, 8, 9 and 10 are exterior views of the three-way marker of the present invention, isometric, front elevation, plan view, right elevation and left elevation respectively.

FIG. 16 is a sectional view of the three-way marker present invention while FIGS. 17-26 are exterior views of the three-way marker of the present invention with the cap in place.

FIG. 27 is a isometric view of the chalk used in the three-way marker present invention while FIGS. 28-32 illustrate the retention sleeve in isometric perspective, side elevation, left elevation, plan view and right elevation, respectively, and FIG. 33 is an enlarged view of the right end of the retention sleeve.

FIGS. 39-42 illustrate the dimensions of the chalk used in the three-way marker of the present invention.

DETAILED DESCRIPTION OF THE PREFERRED EMBODIMENT

The invention is described in detail below with reference to embodiments and examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

Figures 1, 2, 3:
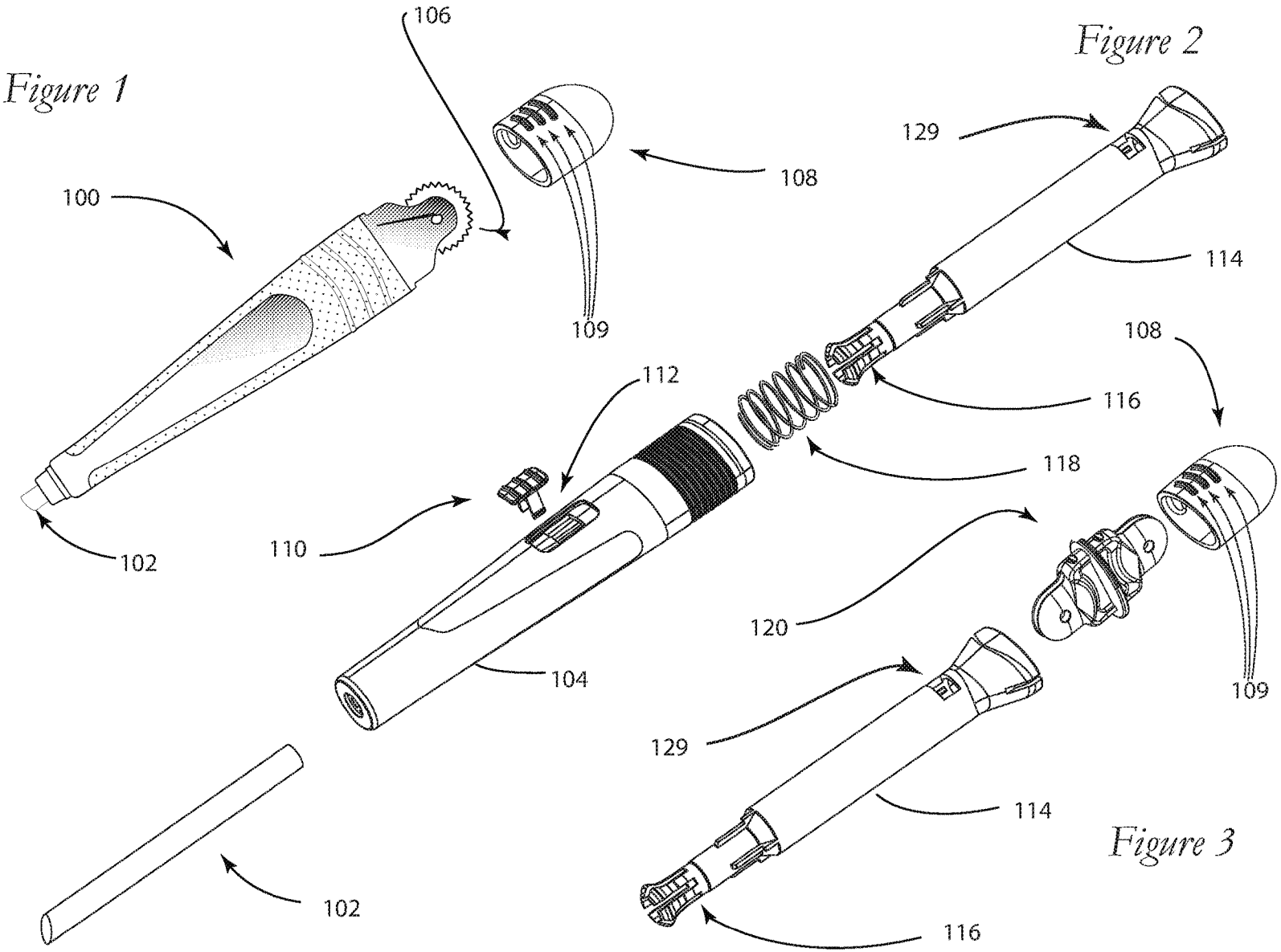
FIG. 1 illustrates an assembled three-way marker of the present invention in which the cap has been removed exposing the serrated tracing disk at one end of the marker and the chalk at the other.
FIG. 2 is an exploded view of the marker illustrating the relationship between the chalk, the generally infundibulate shell, the control actuator, the spring and the retention sleeve.
FIG. 3 illustrates the retention sleeve, the reversible disk holder, and the cap.
Figure 4:
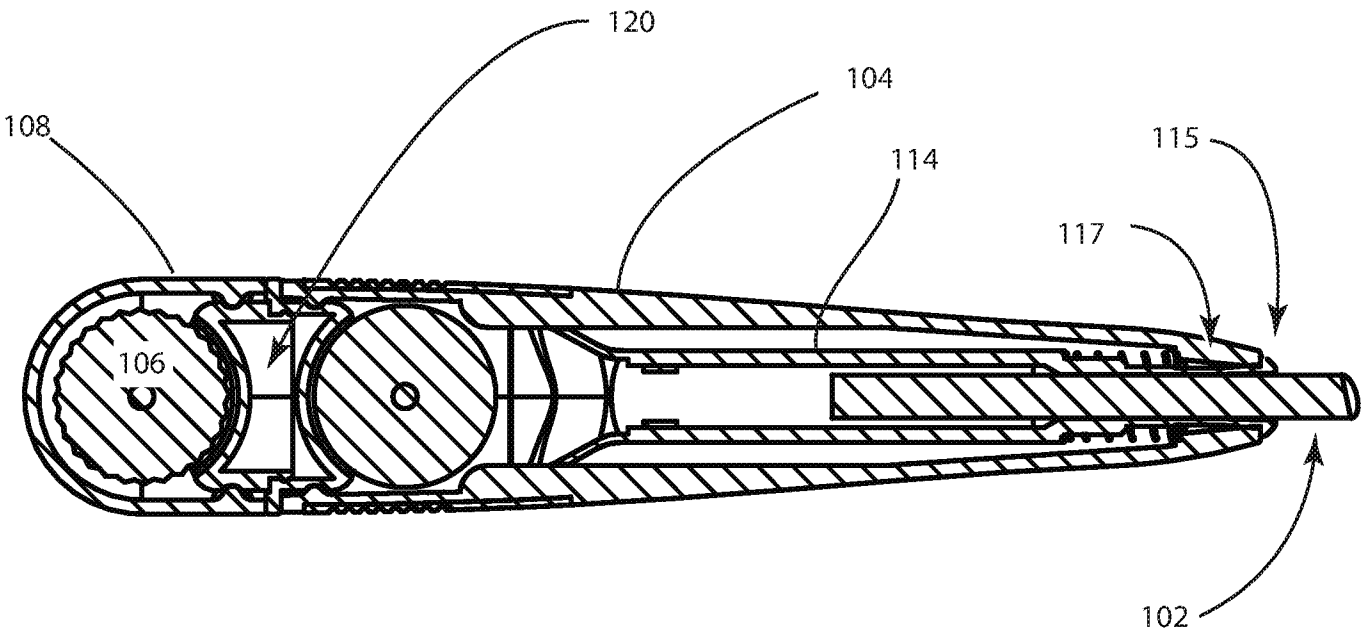
FIG. 4 is a cross-sectional view of the three-way marker of FIG. 1 illustrating the inter-nesting of the various components.
Figure 5:
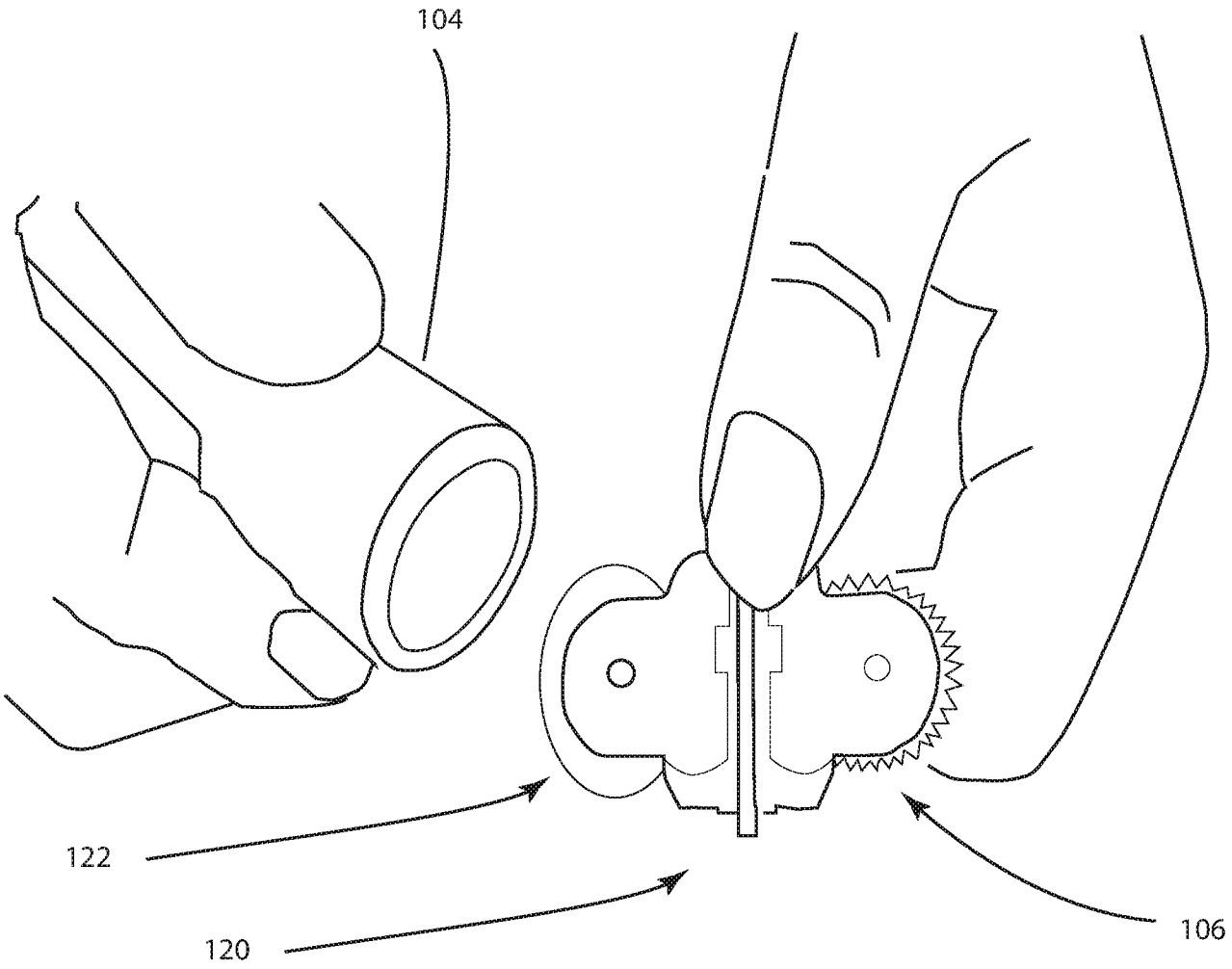
FIG. 5 is a schematic perspective illustrating how the reversible disk mounting bracket fits into the infundibulate shell.
Figures 11, 12, 13, 14, 15:
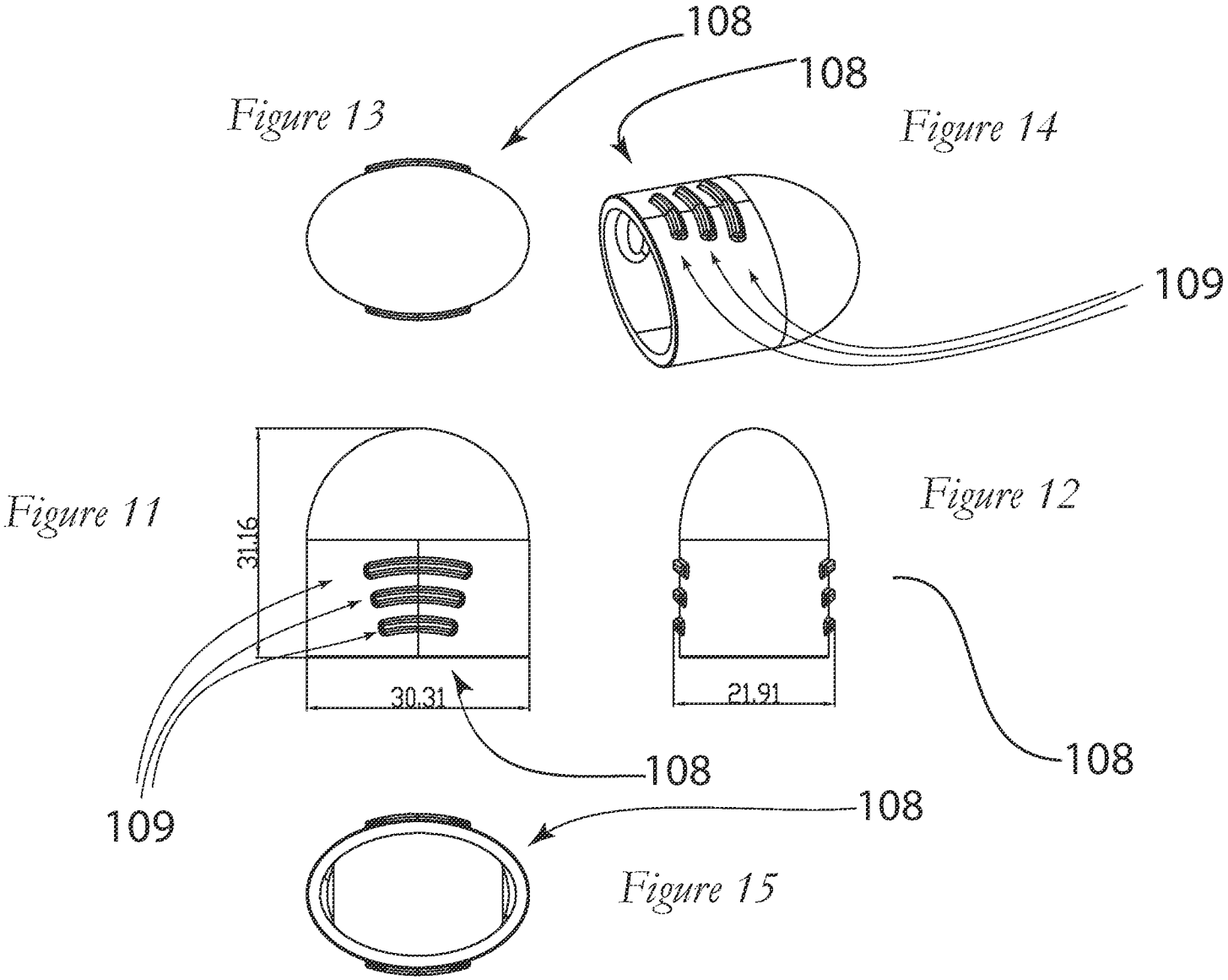
FIGS. 11, 12, 13, 14 and 15 are exterior views of the cap of the present invention: front elevation, side elevation, plan view, isometric, and lower view respectively.
Figures 16, 17, 18, 19, 20, 21, 22, 23, 24, 25, 26:
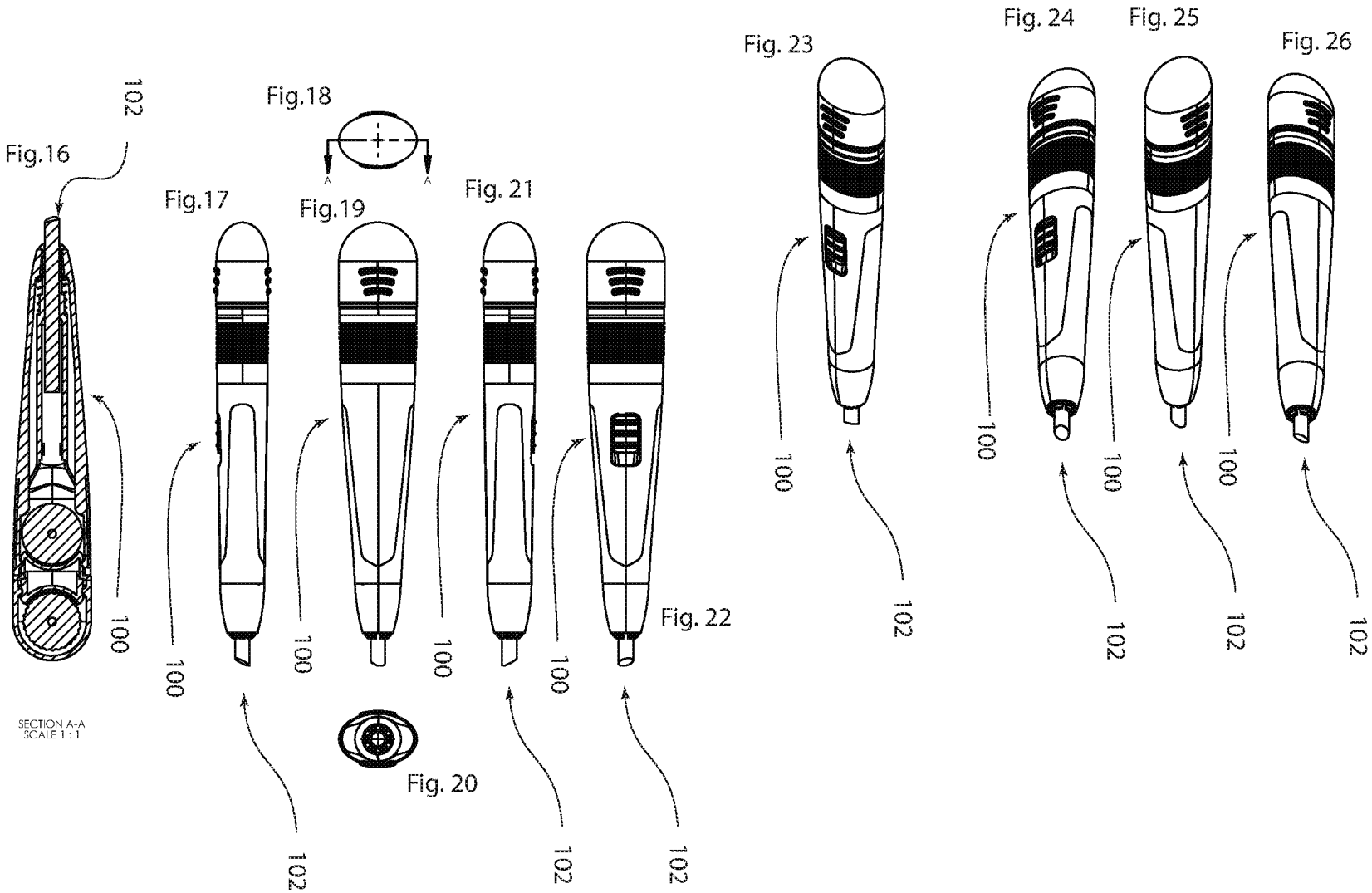

FIG. 1 is in isometric perspective of three-way marker 100 of the present invention with chalk 102, infundibulate shell 104, serrated tracing disk 106 and cap 108 visible. FIG. 2 is an exploded isometric perspective wherein control tab 110 is visible, control tab 110 is operable through slot 112 in infundibulate shell 104. Retention sleeve 114 having collet 116 engages compression spring 118 which engages the interior surface of infundibulate shell 104 having tapered throat 117 (FIG. 4) through which collet 116 passes with compression spring 118 urging outwardly tapered tip 115 (FIG. 4) of collet 116 inwardly against throat 117 in retention sleeve 114, thereby compressing collet 116 around chalk 102 with the pressure exerted by collet 116 being relieved when control tab 110 is urged upwardly. In FIG. 3, retention sleeve 114 as well as reversible marking disk mount 120 are illustrated along with cap 108. Ribs 109 ease removal and handling of cap 108. It should be noted that reversible marking disk mount 120 mates with and engages infundibulate shell 104—not retention sleeve 114 while cap 108 engages and mates with reversible marking disk mount 120. FIG. 5 illustrates mating of infundibulate shell 104 with reversible marking disk mount 120 bearing serrated tracing disk 106 as well as smooth tracing disk 122 making it possible to have one of disks 106 and 122 when available for use with the other being stored interiorly but being readily available nevertheless. FIGS. 6 through 10 provide a variety of views of the overall appearance of three-way marker 100 with cap 108 in place and chalk 102 extending through tapered throat 117. FIGS. 11-15 illustrate the configuration and appearance of cap 108. FIG. 16 is a sectional view of FIG. 18. FIGS. 17-26 are provided to fully illustrate the exterior appearance of three-way marker 100.

Figures 27, 28, 29, 30, 31, 32, 33:
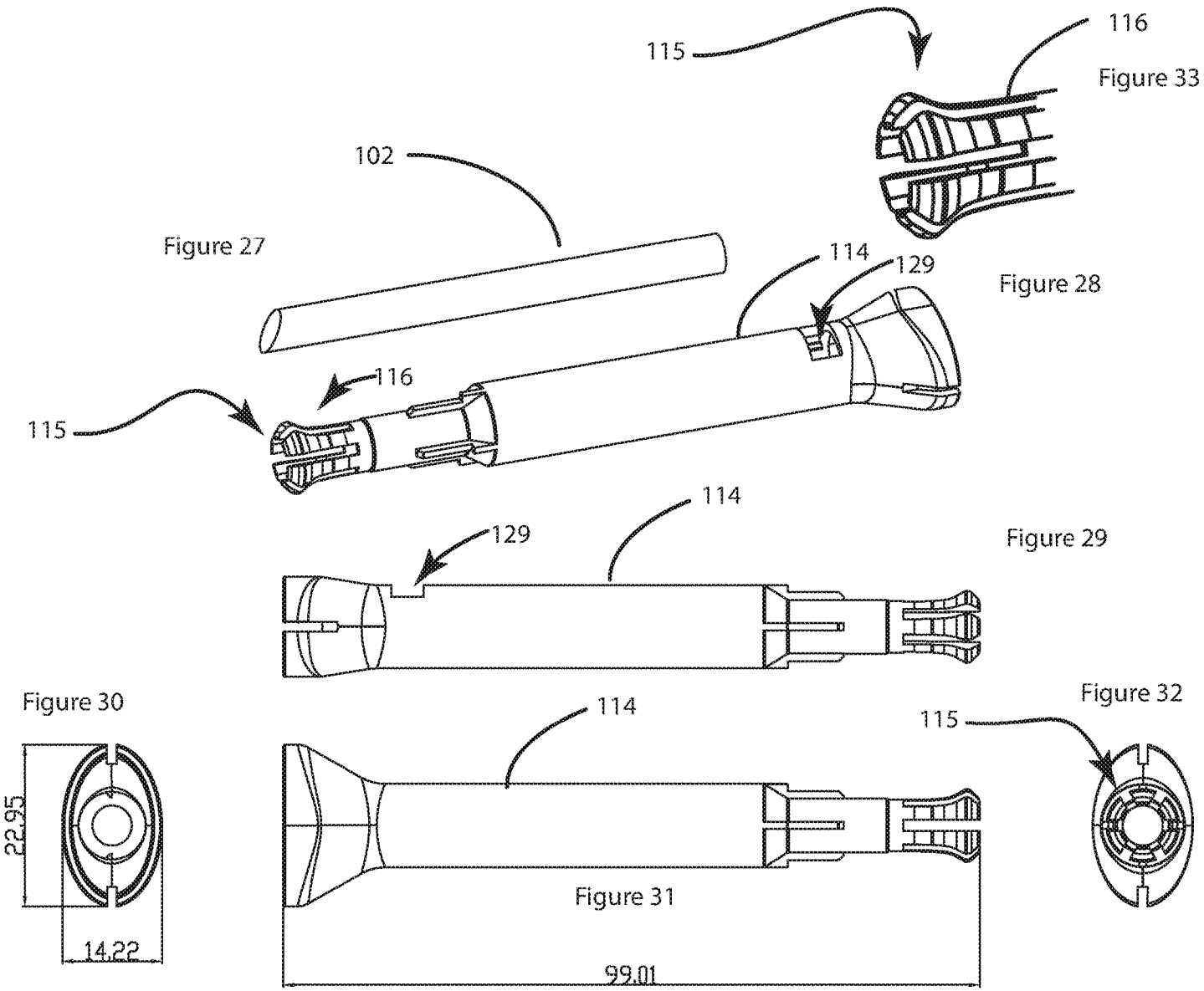
Figure 35:
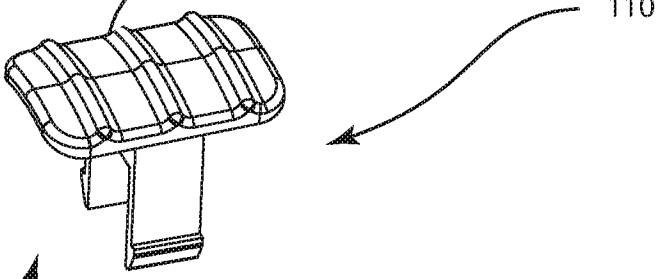
FIGS. 34, 35, 36, 37, and 38 illustrate the control tab used in the three-way marker of the present invention presenting respectively front elevation, isometric view, bottom view, side view and plan view.
Figure 34:
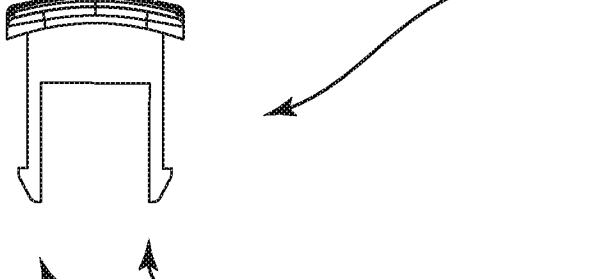
Figure 38:
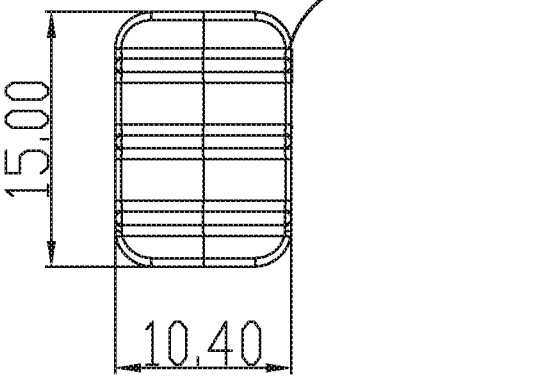
Figure 37:
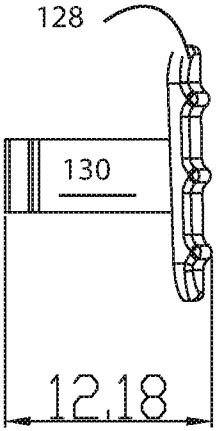
Figure 36:
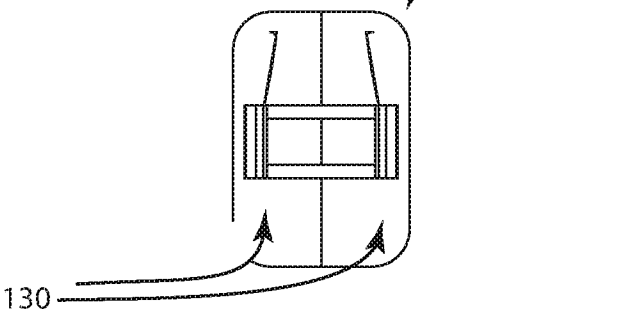

Components shown in exploded FIGS. 1-3 are further illustrated with additional views. FIG. 27 illustrates chalk 102. FIGS. 28 through 33 illustrate collet 116 having outwardly tapered tip 115 on retention sleeve 114 along with control tab receiver slot 129. When viewed in conjunction with FIG. 4, it can be seen that chalk 102 is grasped by collet 116 when retention sleeve 114 is urged into its innermost position by compression spring 118 drawing outwardly tapered tip 115 inwardly against throat 117 while compression is relaxed when collet 116 is urged outwardly bringing outwardly tapered tip 115 out of engagement with throat 117.

Figure 46:
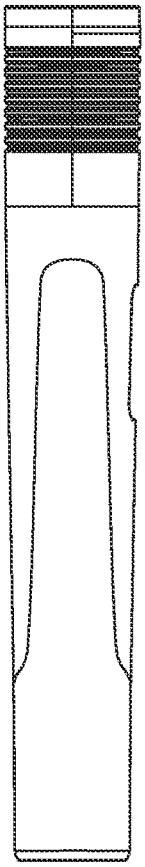
Figure 47:
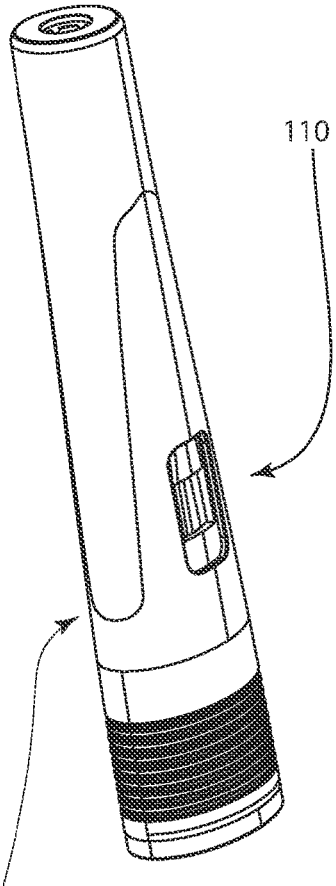
Figure 45:
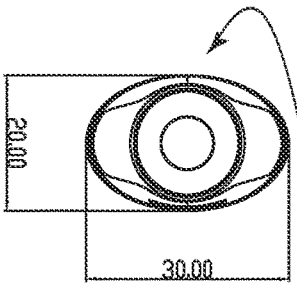
Figure 48:
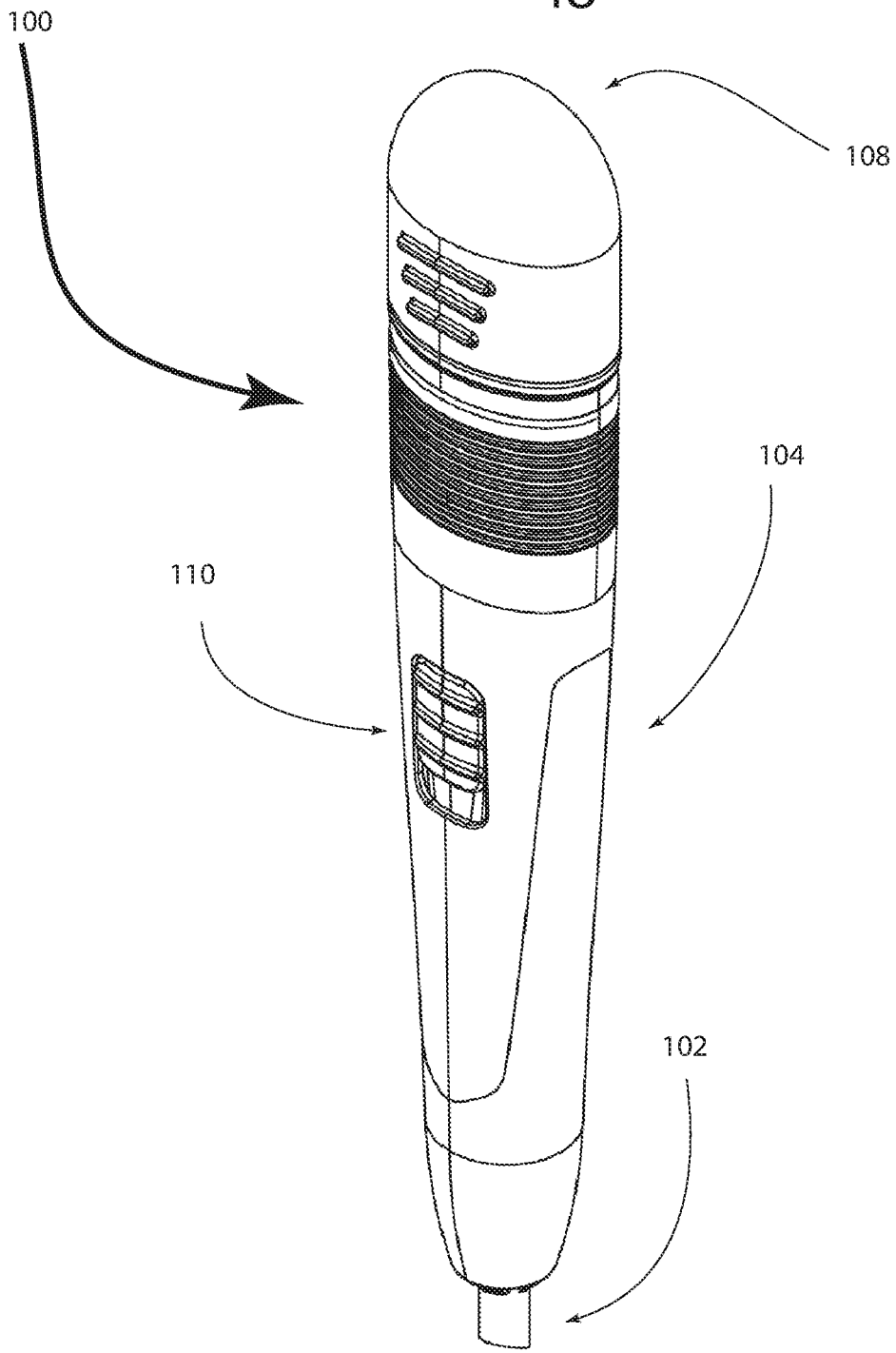
FIG. 48 is another isometric perspective exterior view of the three way marker of the present invention.
Figure 49:
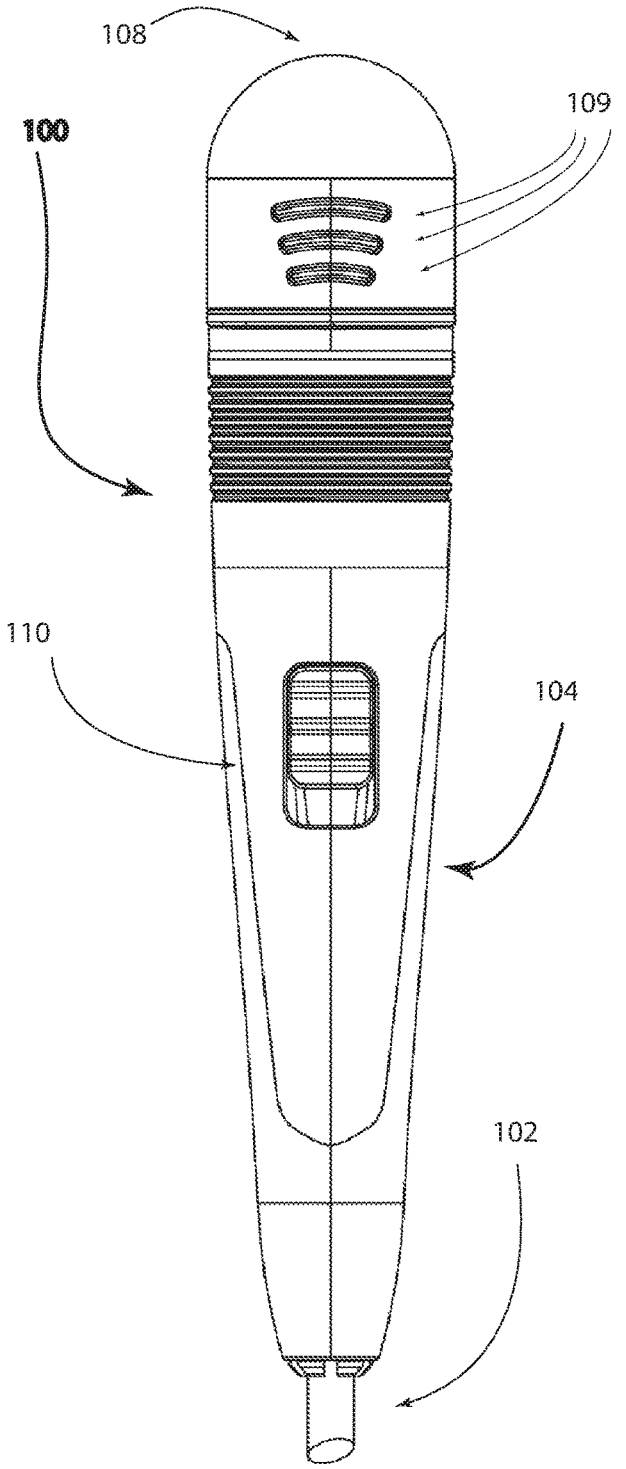
FIGS. 49 and 50 are plan and lower views of the three way marker of the present invention.
Figure 50:
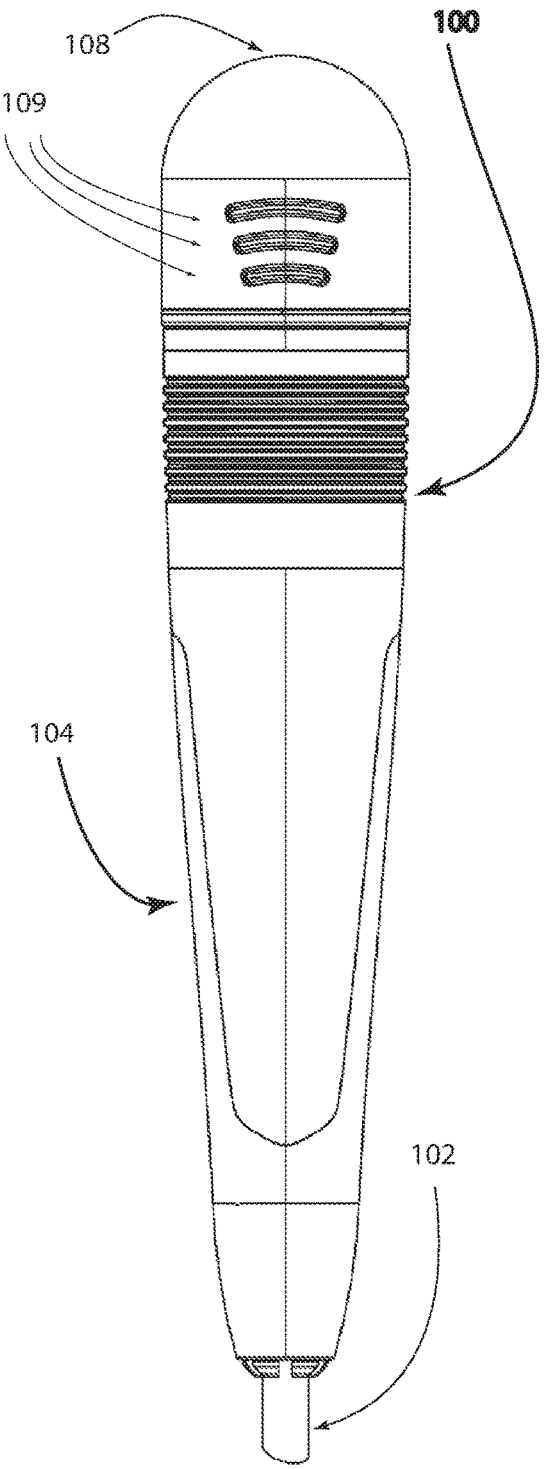
Figure 51:
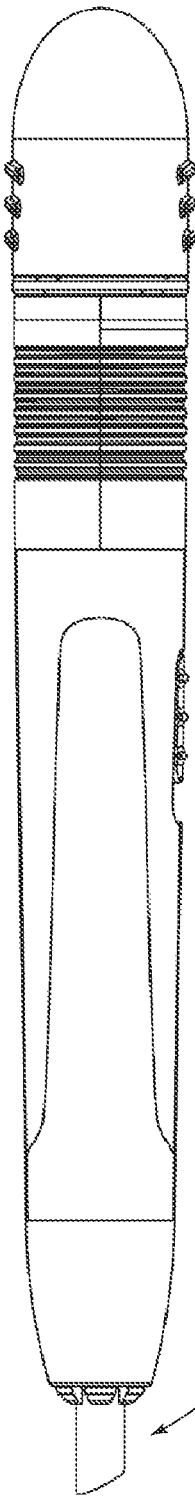
FIGS. 51, 52, 53, and 54 present left elevation, right elevation, top and bottom views of the three way marker of the present invention.
Figure 52:
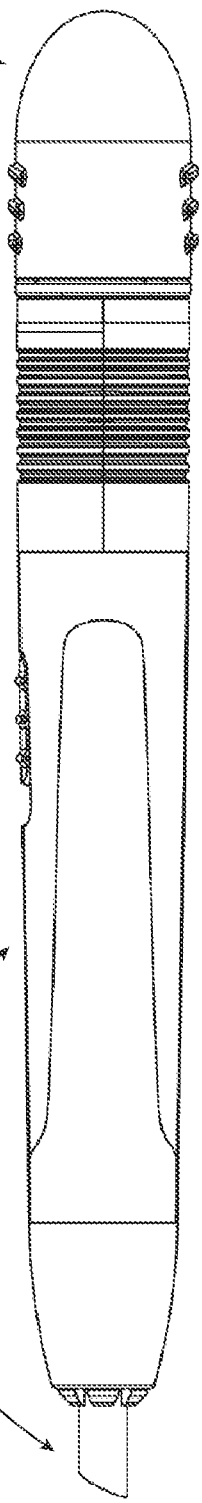
Figure 53:
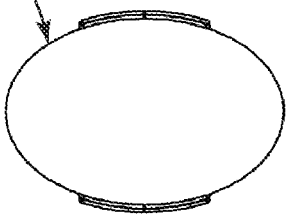
Figure 54:
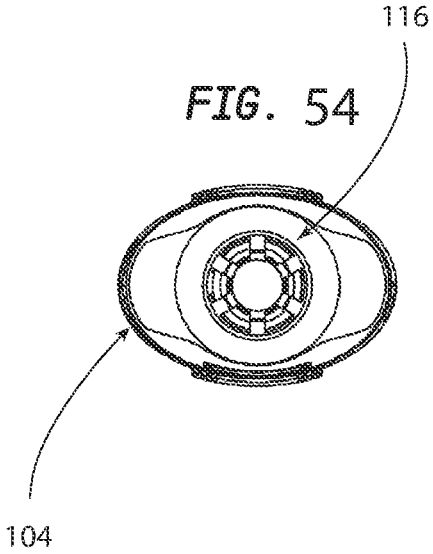

FIGS. 34 through 38 illustrate control tab 110 with gripper pad 128 having downwardly extending lugs 130 attached thereto. In use, lugs 130 extend downwardly through slot 112 in infundibulate shell 104 into engagement slot 129 in retention sleeve 114 whereby outwardly flaring tip 115 of collet 116 may be urged outwardly of throat 117 when pad 128 is engaged and urged toward throat 117 thereby relieving the compressive forces on collet 116 holding chalk 102 in place. FIGS. 39 through 42 illustrate the most preferred dimensions of chalk 102. FIGS. 43 through 47 illustrate the details of the appearance of infundibulate shell 104, while FIG. 48 is another isometric illustration of the overall appearance of three-way marker 100 with FIGS. 49 through 54 providing top, bottom, right side, left side rear and frontal views of three-way marker 100.

Figure 43:
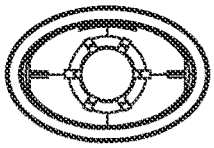
FIGS. 43-47 are exterior views of the infundibulate shell used in the three way marker of the present invention presenting respectively rear elevation, plan view, front elevation, right elevation, and isometric perspective thereof.
Figure 44:
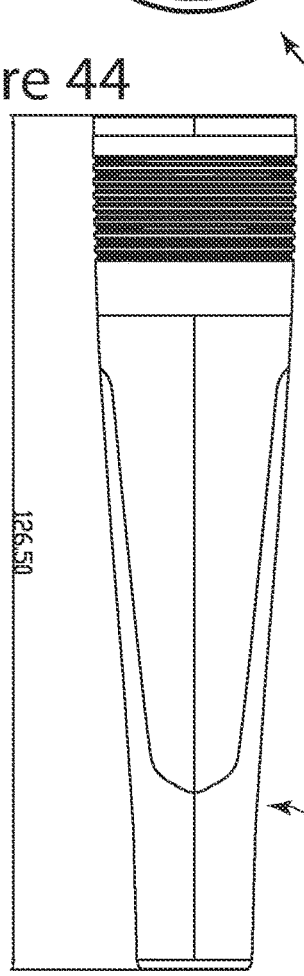

FIGS. 27, 39-40, and 42 are several views of chalk 102. Chalk 102 is also illustrated with exemplary dimensions in FIG. 41. FIGS. 11-15 are several views of cap 108. FIGS. 43 and 46-47 are several views of infundibulate shell 104, which is shown with exemplary dimensions in FIGS. 44-45.

FIGS. 48-54 are additional views of the three-way marker 100 of FIGS. 6-10.

Figure 55:
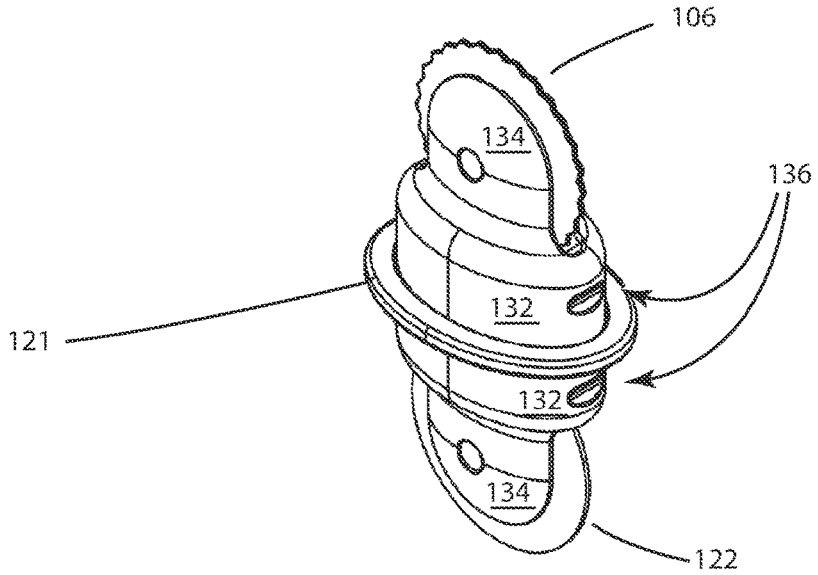
FIGS. 55, 56, and 57 present isometric perspective, front and rear elevation views of the reversible marking disc holder of the three way marker of the present invention.
Figure 56:
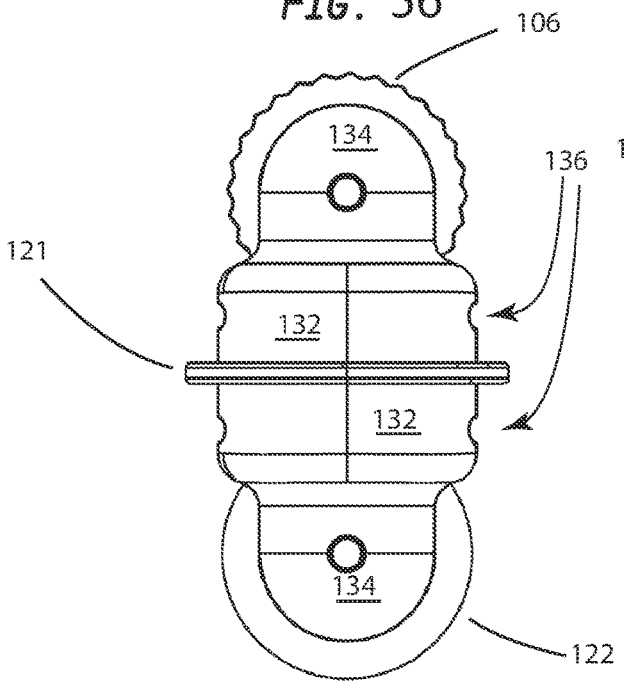
Figure 57:
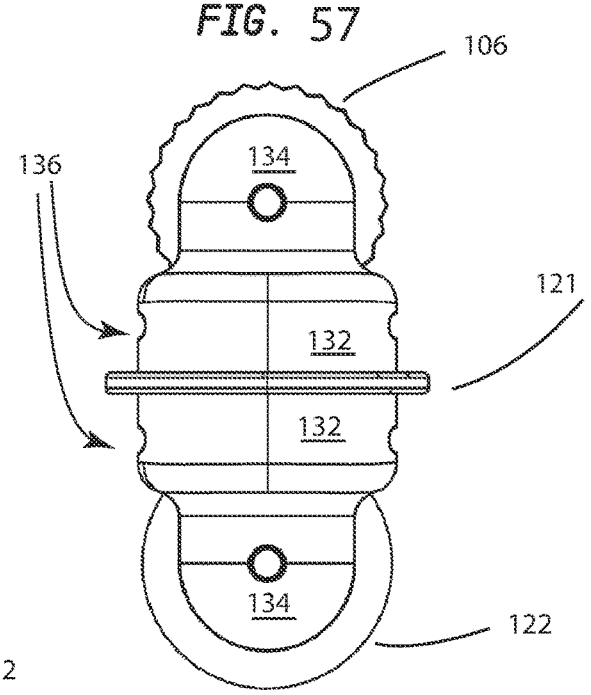
Figure 58:
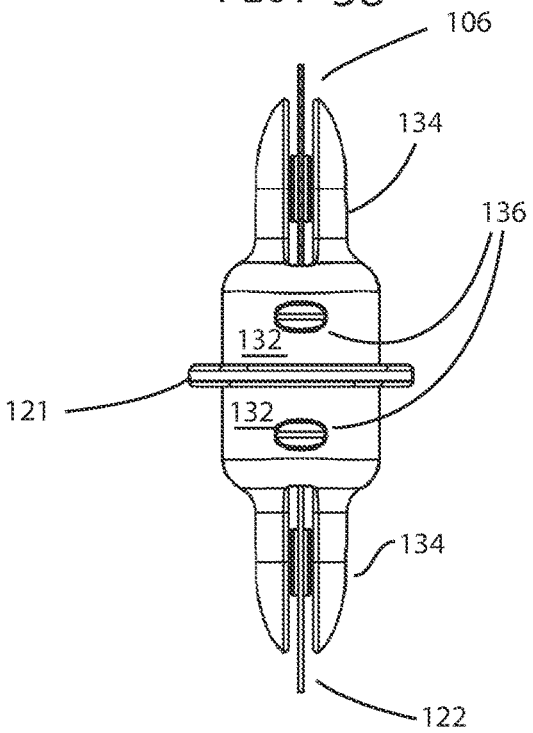
FIGS. 58, 59, 60, and 61 present left, right, top, and bottom views of the reversible marking disc holder of the three way marker of the present invention.
Figure 59:
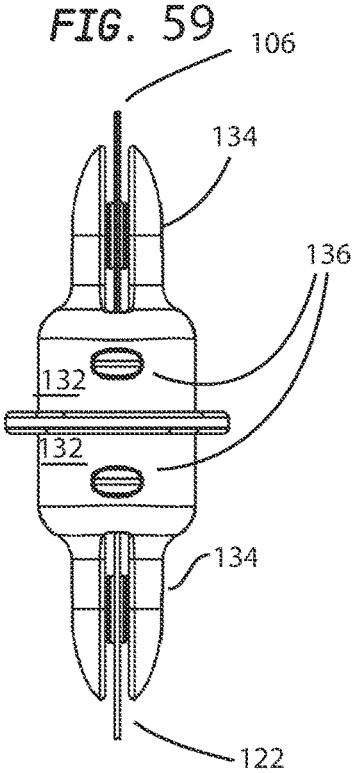
Figure 60:
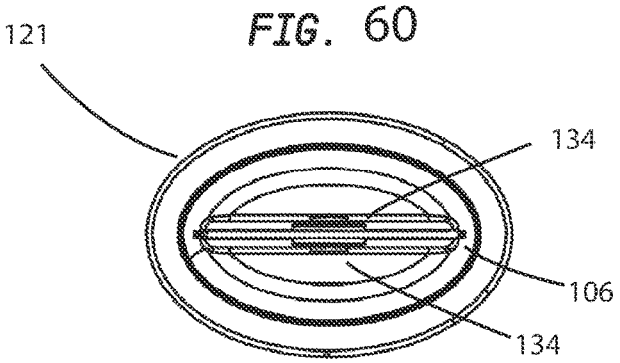
Figure 61:
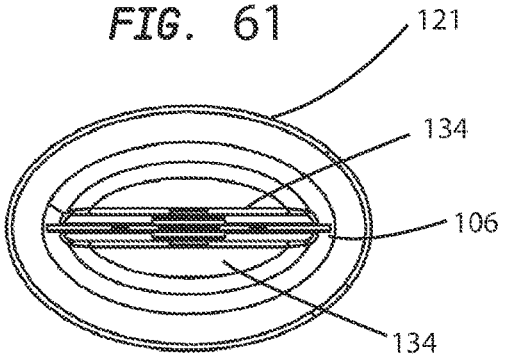
Figure 62:
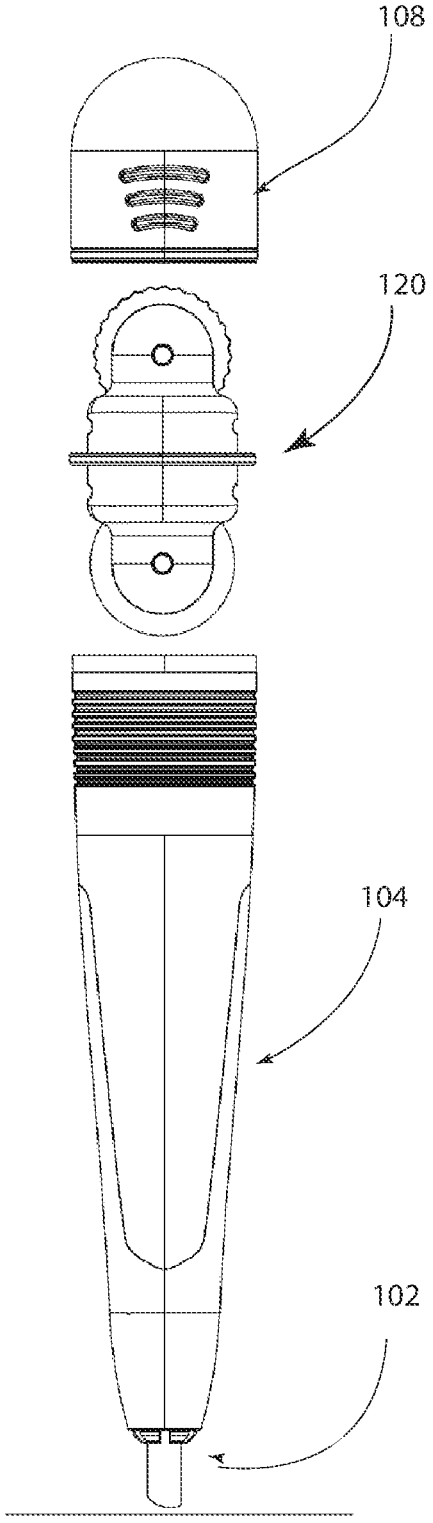
FIGS. 62 and 63 illustrate insertion of the reversible marking disc holder of the three way marker of the present invention into the infundibulate shell of the three-way marker of the present invention.
Figure 63:
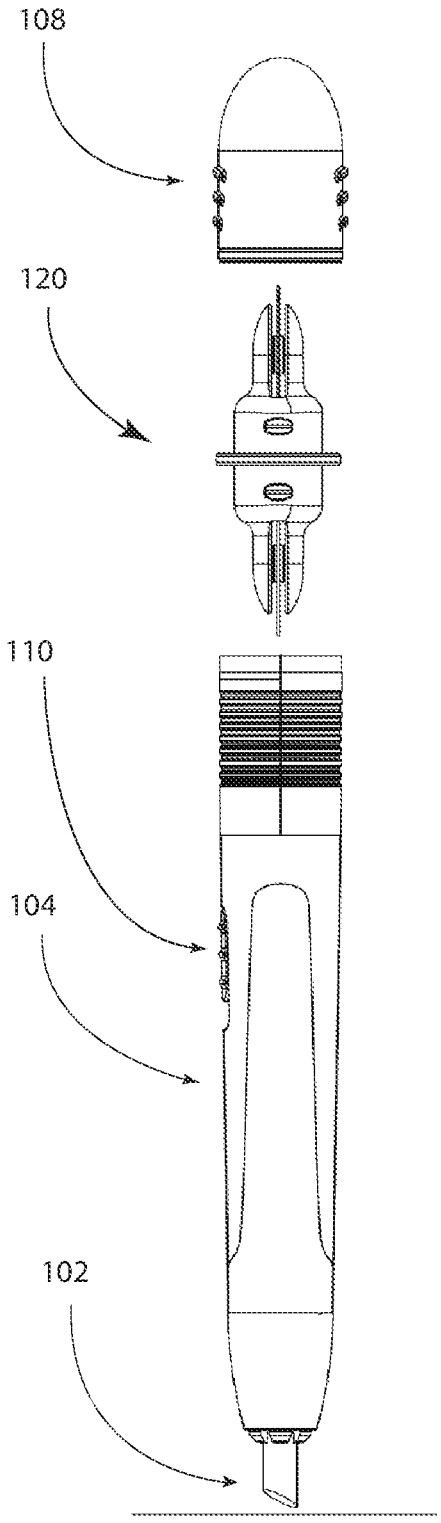
Figure 64:
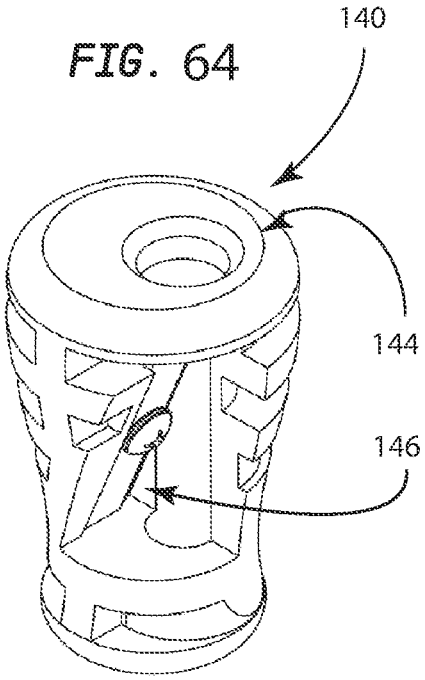
FIGS. 64, 65, 66, and 67 are isometric perspective views of the chalk sharpener of the present invention.
Figure 65:
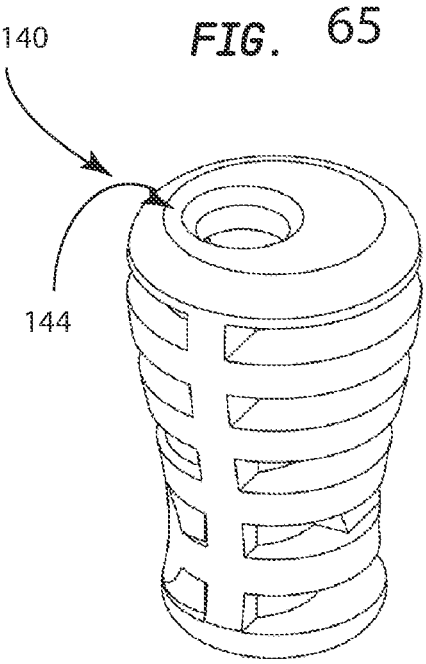
Figure 66:
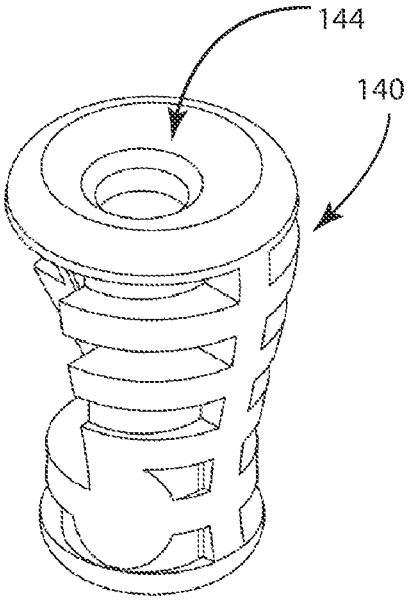
Figure 67:
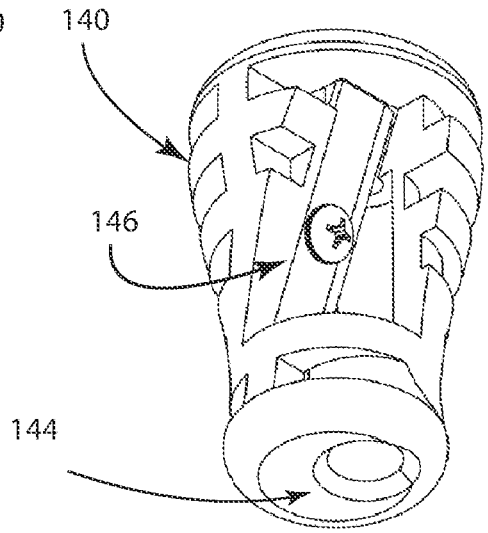
Figure 71:
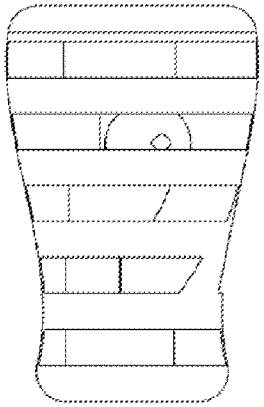
FIGS. 68-75 illustrate details of the chalk sharpener of the present invention.
Figure 70:
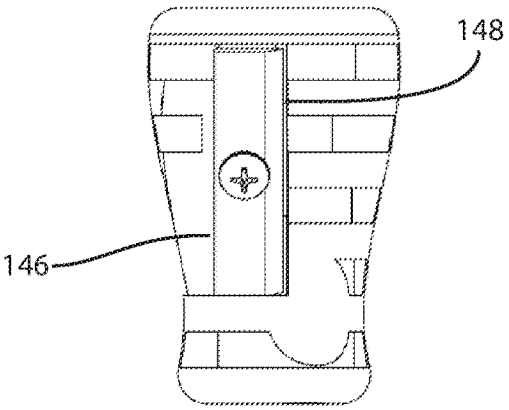
Figure 69:
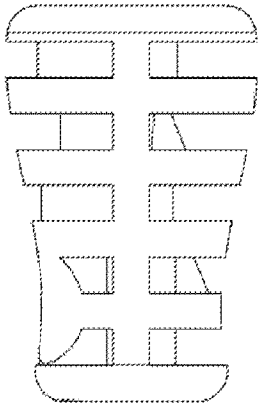
Figure 68:
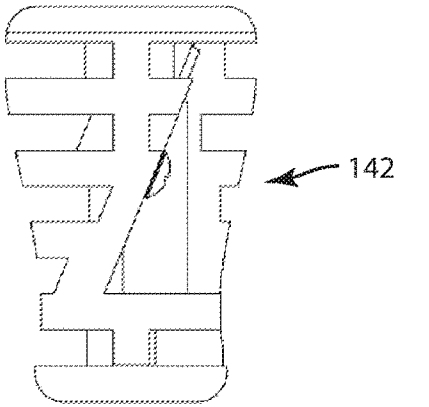
Figure 75:
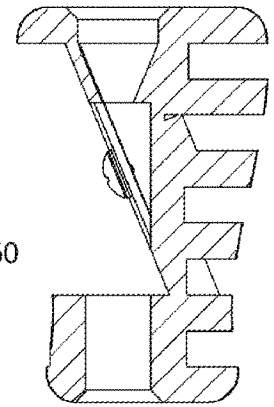
Figure 74:
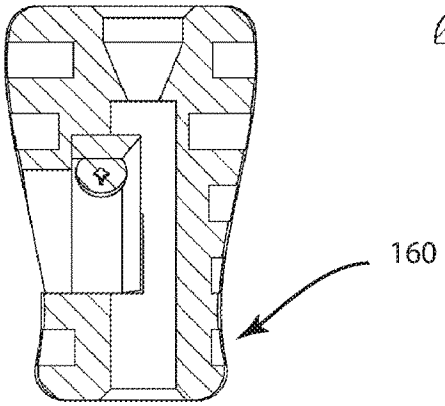
Figure 73:
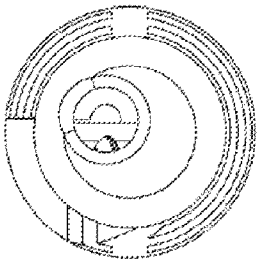
Figure 72:
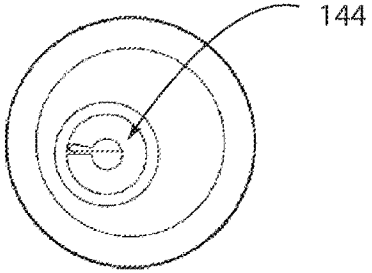
Figure 76:
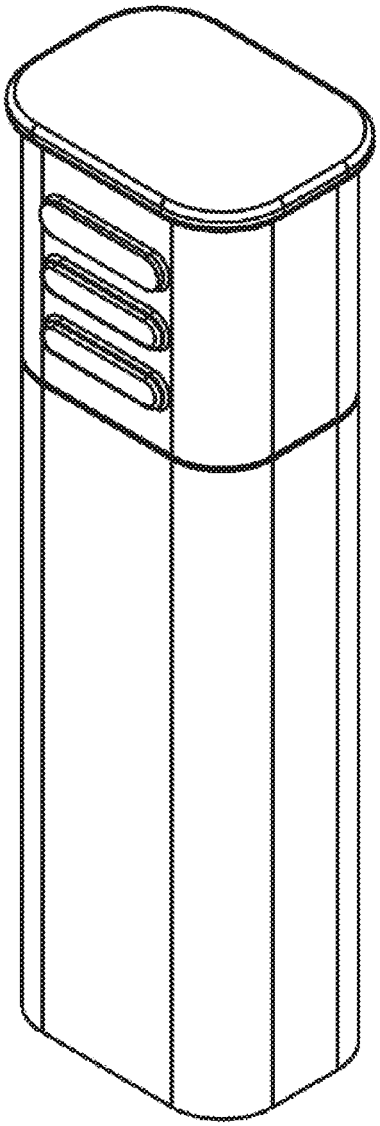
FIGS. 76 and 77 are isometric perspective views of the chalk holder used with the three-way marker of the present invention.
Figure 77:
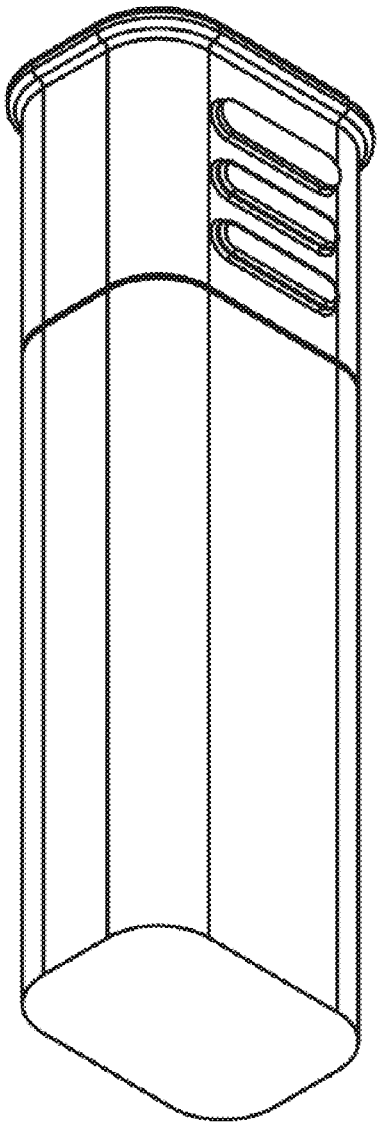
Figure 81:
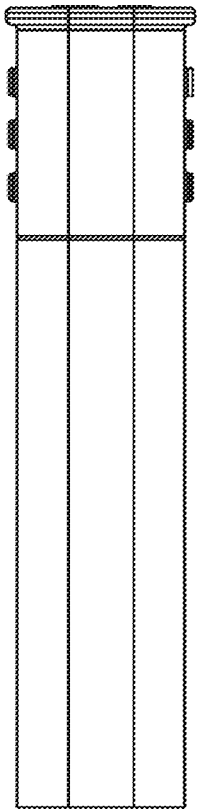
FIGS. 78-81 are front, rear, left and right elevations of the chalk holder used with the three-way marker of the present invention.
Figure 80:
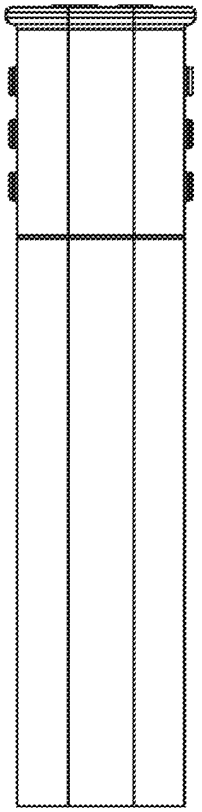
Figure 79:
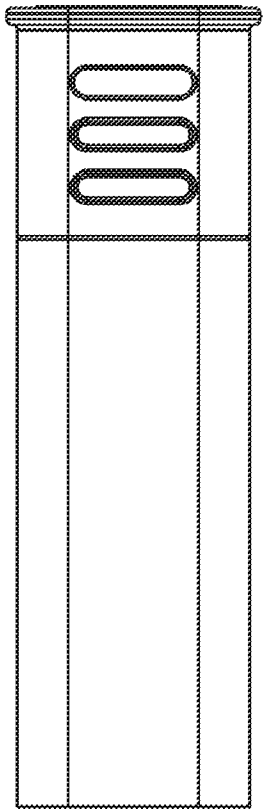
Figure 78:
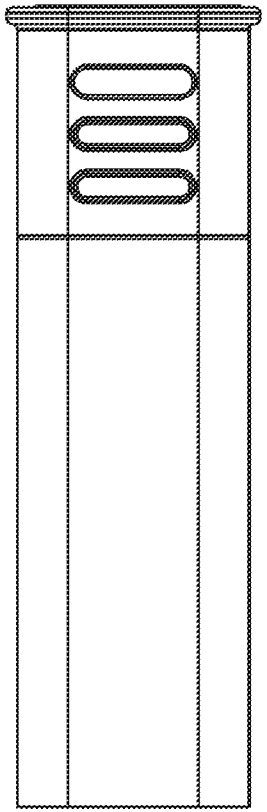
Figure 82:
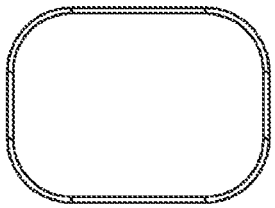
FIGS. 82-85 are top and bottom views of the chalk holder as well as front and side elevations with the cap removed.
Figure 83:
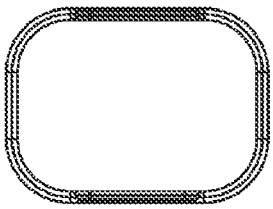
Figure 84:
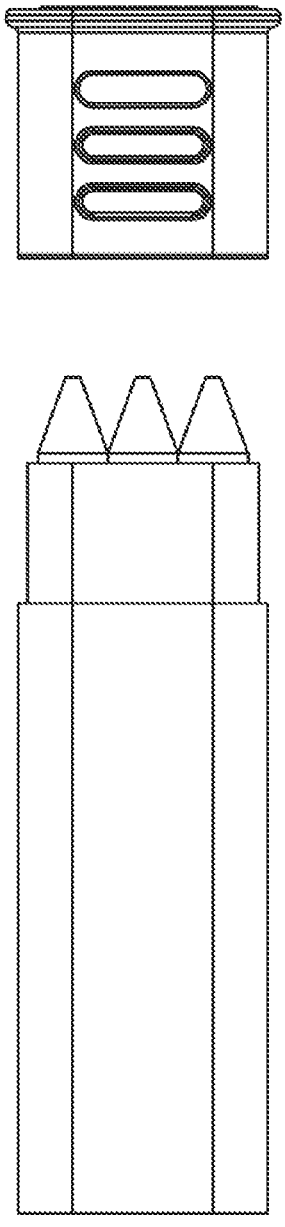
Figure 85:
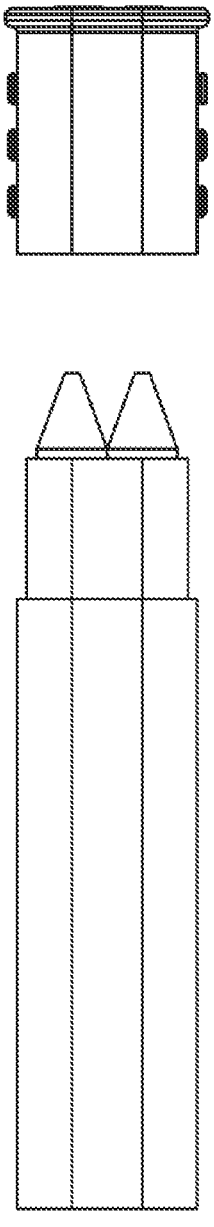

FIGS. 55 through 57 along with FIGS. 58-63 illustrate details of reversible disk mount 120 having stanchions 132 projecting outwardly from either side of a medial retention ridge 121, each stanchion 132 having a pair of mounting lugs 134 projecting outwardly therefrom, each pair of mounting lugs 134 having a rotable tracing wheel 106, 122 mounted therebetween. Preferably one pair of mounting lugs 134 will have a serrated rotatable tracing wheel 106 while the other pair will have a rotatable smooth or circular tracing wheel 122 mounted thereupon. Preferably each stanchion has retention recesses 136 adapted to engage congruent mounting lugs provided in the interior of infundibulate shell 104 as well as in the interior of cap 108 to ensure secure assembly of infundibulate shell 104, reversible disk mount 120 and cap 108 when so desired, with FIGS. 62 and 63 illustrating three way marker 100 with cap 108 and reversible marking disk mount 120 removed from infundibulate shell 104.

FIGS. 64-75 illustrate a chalk sharpener 140 suitable for use with the three-way marker of the present invention. Sharpener 140 comprises a body 142 having passage 144 therethrough with blade 146 secured to body 142 with sharpened edge 148 protruding into passage 144. Sharpener 140 has a pilsner-shaped exterior having an overall height of about 33 mm with relatively flat upper surface 150 having a diameter of about 17 mm with peripheral surface 152 flaring gently outwardly therefrom to shoulder 156 having a diameter of about 21 mm down about 2 mm from top surface 150, then narrowing to a waist 158 located about 26 mm down from upper surface 150, waist 158 having a diameter of about 15 mm with peripheral flaring outwardly to hip 160 having a diameter of 16 mm in diameter at about 30 mm down from surface 150 and narrowing to about 12.5 mm at lower surface 154. Preferably a number of horizontal slots are cut into peripheral surface 152 to further enhance grippability.

Figure 86:
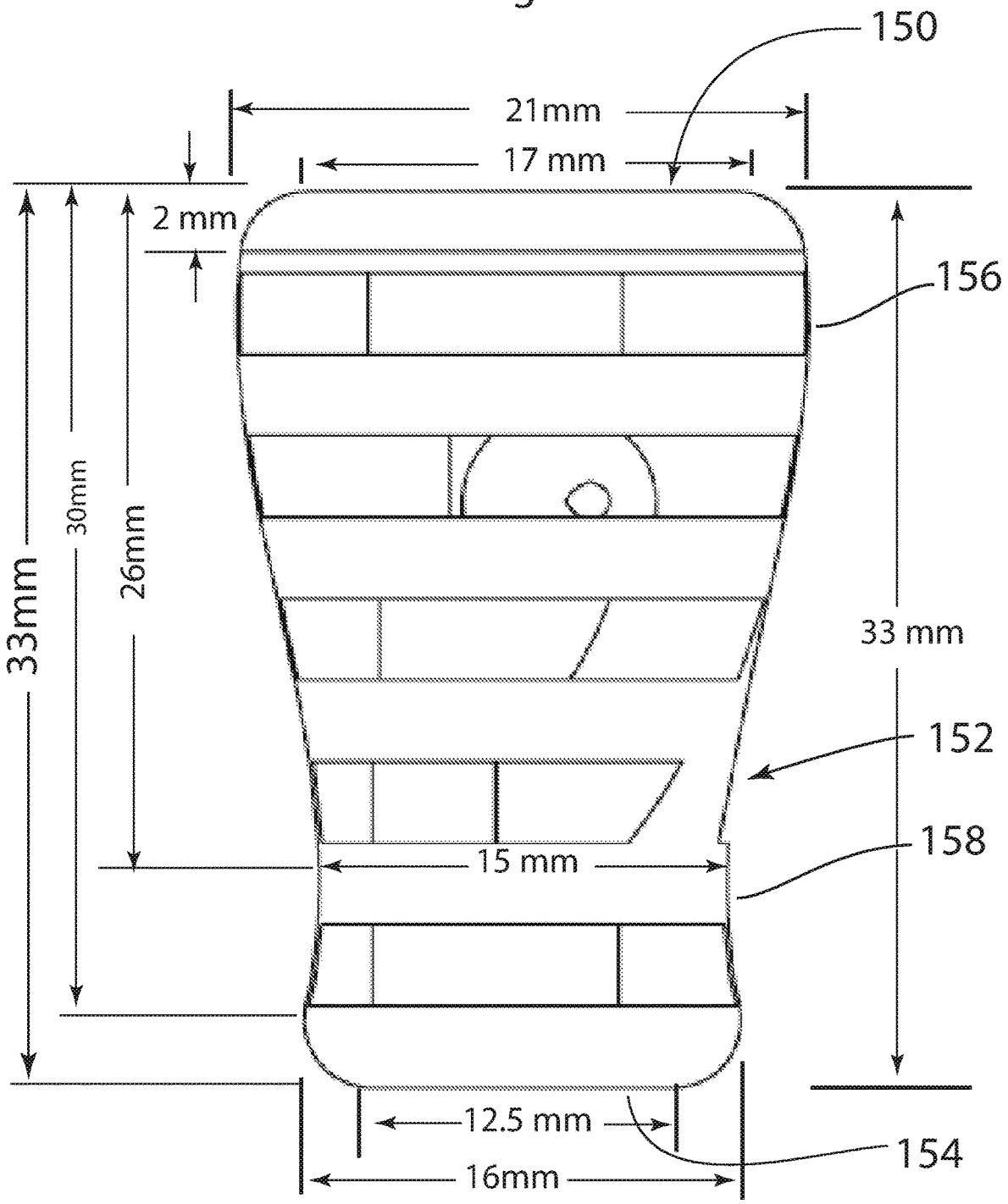
FIG. 86 is a front elevation illustrating the most preferred dimensions of a sharpener for use with the three way marker of the present invention.

FIGS. 76-85 are several views of a chalk holder for holding chalk 102 when not in use, which would of course, normally be prior to use. Exemplary dimensions of chalk sharpener 140 are illustrated in FIG. 86.

While the invention has been described in detail, modifications within the spirit and scope of the invention will be readily apparent to those of skill in the art. In view of the foregoing discussion and relevant knowledge in the art, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As our invention, we claim:

1. A multi-purpose marking tool for use in sewing comprising:

a generally infundibulate shell with walls having an oval cross-section having a longitudinally extending cavity therethrough, said longitudinally extending cavity terminating at one end of said shell in an exit opening and an access opening at the other with a medially located lateral control slot in said shell, the walls of said generally infundibulate shell defining a mounting socket encompassing said access opening;

an elongated retention sleeve having a collet at one end, said collet being adapted to pass through the exit opening of said generally infundibulate shell, said elongated retention sleeve being adapted to be disposed within said generally infundibulate shell; said elongated retention sleeve being adapted to longitudinally reciprocate within said generally infundibulate shell between an extended posture wherein said collet is uncompressed and a retracted posture in which said collet is compressed;

a coiled compression spring encompassing said elongated retention sleeve, engaging an inner surface of said generally infundibulate shell and urging said elongated retention sleeve into said posture in which said collet is compressed;

a control tab extending through said medially located lateral control slot in said shell and engaging said elongated retention sleeve, enabling said elongated retention sleeve to be urged against said compression spring into said extended posture wherein said collet is uncompressed;

a reversible disk holder comprising a flattened cylindrical body having a medial retention ridge defined therebout, said medial retention ridge adapted to reversibly mount in, and be retained within, said mounting socket in said generally infundibulate shell, said body having a pair of lugs extending longitudinally from each end thereof, each pair of lugs being adapted to rotably retain a marking disk therebetween;

a marking disk with a circular periphery and a marking disk with a toothed periphery, the outer periphery of each said marking disk extending beyond said lugs, one said pair of lugs retaining the marking disk with a circular periphery, the other pair retaining the marking disk with a toothed periphery; and a cap adapted to removably mount, and be retained, upon either end of said reversible disk holder, encompassing one said marking disk when so mounted.

2. The multipurpose marking tool of claim 1, wherein the control tab has a gripper pad on one surface thereof and two lugs protruding from another surface of the control tab opposite said gripper pad.

3. The multipurpose marking tool of claim 1, wherein the flattened cylindrical body has at least one retention recess on each side of said medial retention ridge with the infundibulate shell and the cap each having at least one mounting lug congruent to, and adapted to receive, one of the at least one retention recesses, wherein each retention recess is adapted to engage one of the mounting lugs provided in the infundibulate shell and in the cap.

4. A sharpener comprising a body having a passage therethrough with a blade secured to an exterior of said body, said blade having a sharpened edge, said sharpened edge protruding into said passage, said body of said sharpener having an exterior peripheral surface having an overall height of 25-40 mm with a relatively flat upper surface having a diameter of 50 to 60% of said height of said sharpener with said peripheral surface flaring gently outwardly from the relatively flat upper surface to a shoulder having a diameter which is both 60 to 70% of said height of said sharpener and greater than the diameter of said upper surface, said shoulder being at 90-99% of the height of said sharpener, said peripheral surface narrowing to a waist located at a height of 15-30% of the overall height of said sharpener, said waist having a diameter of 40-50% of the height of said sharpener, said peripheral surface flaring outwardly to a hip having a diameter at least 5-15% greater than the diameter of said waist, said hip being located between said waist and a lower surface.

5. The sharpener of claim 4, wherein a plurality of horizontal slots are cut into said peripheral surface perpendicular to said passage to enhance grippability.

6. A marker ensemble comprising a multi-purpose marking tool for use in sewing and a sharpener, said multipurpose marking tool comprising:

a generally infundibulate shell with walls having an oval cross-section having a longitudinally extending cavity therethrough, said longitudinally extending cavity terminating at one end of said shell in an exit opening and an access opening at the other with a medially located lateral control slot in said shell, the walls of said generally infundibulate shell defining a mounting socket encompassing said access opening;

an elongated retention sleeve having a collet at one end, said collet being adapted to pass through the exit opening of said generally infundibulate shell, said elongated retention sleeve being adapted to be disposed within said generally infundibulate shell; said elongated retention sleeve being adapted to longitudinally reciprocate within said generally infundibulate shell between an extended posture wherein said collet is uncompressed and a retracted posture in which said collet is compressed;

a coiled compression spring encompassing said elongated retention sleeve, engaging an inner surface of said generally infundibulate shell and urging said elongated retention sleeve into said posture in which said collet is compressed;

a control tab extending through said medially located lateral control slot in said shell and engaging said elongated retention sleeve, enabling said elongated retention sleeve to be urged against said compression spring into said extended posture wherein said collet is uncompressed;

a reversible disk holder comprising a flattened cylindrical body having a medial retention ridge defined thereabout, said medial retention ridge adapted to reversibly mount in, and be retained within, said mounting socket in said generally infundibulate shell, said body having a pair of lugs extending longitudinally from each end thereof, each pair of lugs being adapted to rotably retain a marking disk therebetween;

a marking disk with a circular periphery and a marking disk with a toothed periphery, the outer periphery of each said marking disk extending beyond said lugs, one said pair of lugs retaining the marking disk with a circular periphery, the other pair retaining the marking disk with a toothed periphery; and a cap adapted to removably mount, and be retained, upon either end of said reversible disk holder, encompassing one said marking disk when so mounted; and the sharpener comprising:

a body having a passage therethrough with a blade secured to said body said blade having a sharpened edge, said sharpened edge protruding into said passage, said body of said sharpener having an exterior peripheral surface having an overall height of 25-40 mm with a relatively flat upper surface having a diameter of 50 to 60% of said height of said sharpener with said peripheral surface flaring gently outwardly from the relatively flat upper surface to a shoulder having a diameter which is both 60 to 70% of said height of said sharpener and greater than the diameter of said upper surface, said shoulder being at 90-99% of the height of said sharpener, said peripheral surface narrowing to a waist located at a height of 15-30% of the overall height of said sharpener, said waist having a diameter of 40-50% of the height of said sharpener, said peripheral surface flaring outwardly to a hip having a diameter at least 5-15% greater than the diameter of said waist, said hip being located between said waist and a lower surface.

7. The marker ensemble of claim 6, further comprising a chalk holder.

8. The marker ensemble of claim 7, wherein said chalk holder further comprises a lid, two opposing sides of which have rounded rectangular grip protrusions.

9. The marker ensemble of claim 7, wherein said chalk holder is dimensioned and configured to contain six chalks when filled.

10. The marker ensemble of claim 6, further comprising a chalk, wherein said chalk is at least about 4 mm in diameter.

* * * * *